US007237945B2

(12) United States Patent
Geyer

(10) Patent No.: US 7,237,945 B2
(45) Date of Patent: Jul. 3, 2007

(54) OSCILLATING SYSTEM FOR MECHANICAL TIMEPIECE

(75) Inventor: Helmut Geyer, Glashütte (DE)

(73) Assignee: Lange Uhren GmbH, Glashuette (DE)

( * ) Notice: Subject to any disclaimer, the term of this patent is extended or adjusted under 35 U.S.C. 154(b) by 298 days.

(21) Appl. No.: 10/945,595

(22) Filed: Sep. 21, 2004

(65) Prior Publication Data

US 2005/0073912 A1 Apr. 7, 2005

(30) Foreign Application Priority Data

Oct. 2, 2003 (DE) ..... 103 45 918

(51) Int. Cl.
*G04B 17/04* (2006.01)

(52) U.S. Cl. ..... 368/178; 368/175

(58) Field of Classification Search ..... 368/178, 368/175–177, 124–125, 127, 140, 142, 144, 368/168–169

See application file for complete search history.

(56) References Cited

U.S. PATENT DOCUMENTS 221,180 A * 11/1879 Monday et al. ..... 368/178
2,584,786 A * 2/1952 Burghoff ..... 29/896.3
2,698,509 A * 1/1955 Valkenburgh et al. ..... 368/175
2,896,399 A * 7/1959 Giroud ..... 368/176
3,241,307 A * 3/1966 Dickerman ..... 368/176
5,907,524 A * 5/1999 Marmy et al. ..... 368/175
6,554,468 B1 * 4/2003 Manaka et al. ..... 368/127

FOREIGN PATENT DOCUMENTS

| | | |
|---|---|---|
| CH | 24677 | 2/1902 |
| DE | 44 35 704 C2 | 4/1996 |
| GB | 1126645 | 9/1968 |

OTHER PUBLICATIONS http://www.oh2002/04/03/um/page-article81B50.html: NZZ Online 3.4.2002 "Starkes Herz" by George Daniels erfindet Hemmungen, Mar. 31, 2004.

* cited by examiner

*Primary Examiner*—Vit Miska
*Assistant Examiner*—Sean Kayes
(74) *Attorney, Agent, or Firm*—Cohen Pontani Lieberman & Pavane LLP

(57) ABSTRACT

An oscillating system for a mechanical timepiece includes an annular balance wheel arranged in a fixed manner coaxially in relation to a rotatably mounted balance staff. A helical spring encloses the balance staff and has its inner end fastened on the balance staff and its outer end fastened on a fastening device. The fastening device has a helical-spring connector with an inner clamping jaw and an outer clamping jaw, the inner clamping jaw being radially inside of the outer clamping jaw in relation to the axis of rotation of the balance staff. The outer end of the helical spring may be clamped firmly between a clamping surface of the inner clamping jaw and a clamping surface of the outer clamping jaw.

26 Claims, 2 Drawing Sheets

OSCILLATING SYSTEM FOR MECHANICAL TIMEPIECE

BACKGROUND OF THE INVENTION

1. Field of the Invention

The invention relates to an oscillating system for a mechanical timepiece having an annular balance wheel which is arranged in a fixed manner coaxially on a rotatably mounted balance staff and a helical spring which encloses the balance staff, wherein an inner end of the helical spring is fastened on the balance staff and an outer end of the helical spring is fastened on a fastening device.

2. Description of the Related Art

In known oscillating systems with a regulator, the regulator is mounted in a rotatable manner about the axis of rotation of a balance staff. A balance wheel is rotatably mounted on the balance staff. The length of a helical spring connected between the balance staff and the balance wheel can be regulated by pivoting the regulator. The setting of the frequency, i.e. the daily rate of the timepiece, is performed by changing the direction moment of the helix, that is to say of the torque of the helix upon deflection through 57.296°, corresponding to one rad.

In oscillating systems without a regulator, it is known to set the frequency by changing the mass moment of inertia of the balance wheel. The balance wheel has regulating elements for this purpose. The setting range is small and can thus only be used for precision adjustment. Rough adjustment takes place by the helical springs and the balance wheels being measured on specific instruments and being assigned in relation to one another such that the daily rate of the oscillating system is less than 1 min/day.

SUMMARY OF THE INVENTION

An object of the present invention is to provide an oscillating system for a timepiece which, along with a straightforward construction, allows both rough adjustment and precision adjustment without the use of a regulator.

The object of the present invention is achieved by an oscillating system including a fastening device with a helical-spring connector that has an inner clamping jaw and an outer clamping jaw, the inner clamping jaw being arranged radially inside of the outer clamping jaw in relation to the axis of rotation of the balance staff. The outer end of the helical spring is clamped firmly between a clamping surface of the inner clamping jaw and a clamping surface of the outer clamping jaw.

This design allows, by straightforward means, the length of the helix to be changed relatively precisely, despite the lack of a regulator, for the purpose of rough adjustment. This is done by the clamping jaws being detached from one another and the outer end of the helical spring being gripped, e.g. by means of pincers, and, depending on the correction required, being displaced by a corresponding distance, changing the effective length of the helix in the process, and then being clamped in again between the clamping jaws.

For straightforward positioning of the clamping jaws in relation to one another, the radially inner clamping jaw may be arranged in a fixed manner and the radially outer clamping jaw may be approximately radially movable.

Bracing of the clamping jaws is easily possible in that the inner clamping jaw and the outer clamping jaw can be braced against one another by a clamping screw.

For this purpose, it is possible, in an easy-to-assemble manner, for the clamping screw to be guided through an aperture of the outer clamping jaw, the aperture being directed approximately radially in relation to the balance staff, to have its screw head supported on the outer clamping jaw and to have its threaded shank screwed into a threaded bore in the inner clamping jaw, the threaded bore being approximately coaxial in relation to the aperture.

To prevent the two clamping jaws from being offset in relation to one another in any way during the clamping operation, the clamping screw is a countersunk head screw, of which the countersunk head can be inserted with centering action into a corresponding depression in the mouth-opening region of the aperture of the outer clamping jaw which is directed away from the inner clamping jaw.

So that the outer end of the helical spring can easily be positioned in a precise manner, the clamping surfaces of at least one of the inner and outer clamping jaws may be curved approximately concentrically in relation to the balance staff.

For adjustment purposes, all that is thus required is for the clamping surfaces to be moved apart slightly from one another to allow the helical spring to be positioned without this resulting in the helical spring being resiliently twisted in the slot between the clamping jaws.

An assembly in which the components are located precisely one upon the other without the outer end of the helical spring being deformed is achieved if the clamping surface of the outer clamping jaw is curved concentrically in relation to the axis of rotation of the balance staff with a radius of curvature which is greater, by approximately the thickness of the helical spring, than the radius of curvature of the clamping surface of the inner clamping jaw, which is also curved concentrically in relation to the axis of rotation of the balance staff.

If the clamping surface of the inner clamping jaw extends along a radius of curvature, in relation to the axis of rotation of the balance staff, which corresponds approximately to the radius of curvature of the outer end of the helical spring, then the helical spring is not deformed in any way and it can be displaced and positioned smoothly for adjustment purposes when the helical spring is clamped.

The helical spring is clamped more or less directly between the clamping jaws if the outer end of the helical spring extends axially in relation to the axis of rotation of the balance staff along one axial side of the clamping screw, between the clamping surfaces of the inner and outer clamping jaws.

The outer clamping jaw may have a supporting surface on that axial side of the clamping screw which is located opposite the end of the helical spring in relation to the axis of rotation. The supporting surface is curved in relation to the axis of rotation of the balance staff with a radius of curvature which corresponds approximately to the radius of curvature of the clamping surface of the inner clamping jaw. This avoids tilting of the outer clamping jaw during bracing.

The outer clamping jaw may be connected to the inner clamping jaw by a spring arm. When the outer clamping jaw is detached from the inner clamping jaw, the spring arm retains the outer clamping jaw in a position in which it is aligned largely precisely in relation to the inner clamping jaw and the helical spring, thus facilitating the adjusting operation.

This alignment is achieved in a particularly reliable manner if the spring arm is a leaf-spring arm of approximately rectangular cross section, the long cross-section sides being directed parallel to the axis of rotation of the balance staff.

The spring arm may extend here approximately in the manner of a swan neck from the inner clamping jaw to the outer clamping jaw.

By changing the effective length of the helix, the adjustment, as it were, is no longer correct. This means that the balance wheel is no longer symmetrical in relation to the pallet. To allow this symmetrical position to be easily restored, the inner clamping jaw may be fastened on a retaining ring which, capable of being adjusted in a rotatable manner through a certain angle range, engages with a force fit and/or form fit and/or friction fit around a cylinder component which is coaxial in relation to the axis of rotation of the balance staff.

This correction takes place simply by rotating the retaining ring on the cylinder component and overcoming the force fit and/or form fit and/or friction fit.

The rotation of the retaining ring is particularly straightforward here, and the retaining ring is reliably retained in its adjusted position, if the retaining ring is an open retaining ring, of which the opening is located approximately diametrically opposite the inner clamping jaw and which engages with a radially inwardly directed spring force around the cylinder component.

To ensure that the retaining ring engages in a play-free manner around the cylinder component, the inner radius of curvature of the retaining ring may be slightly larger in the region of the inner clamping jaw than in the region of the opening of the retaining ring.

For precision adjustment, it is possible for the cylinder component to be adjusted in a rotatable manner about the axis of rotation of the balance staff and to have a radially projecting regulator pointer.

For this purpose, the regulator pointer may preferably be adjusted in a pivotable manner about the axis of rotation of the balance staff by a setting mechanism, it being possible for the setting mechanism to be a setting screw which pivots the regulator pointer counter to the force of a spring.

Designing the setting screw as a precision setting screws allows particularly precise adjustment.

Straightforward construction is further achieved if the spring is a swan neck-shaped spring which has one end arranged in a fixed manner and butts with prestressing against the regulator pointer.

A stop may be arranged in the region of that end of the clamping surface of the inner clamping jaw in the vicinity of the outer end of the helical spring. The stop projects in the direction of the outer clamping jaw and on which the region of the outer end of the helical spring can be supported axially in relation to the axis of rotation of the balance staff. This arrangement prevents the outer end of the helical spring from dropping out of the clamping jaws when the latter are detached from one another.

In order to reduce the number of components, the inner clamping jaw and the stop may be formed in one piece.

The outer clamping jaw may be supported on the stop axially in relation to the axis of rotation of the balance staff. This arrangement prevents the outer clamping jaw from rotating about the screw axis during tightening or loosening of the retaining screws.

For adjustment of the retaining ring, the retaining ring can be adjusted in a rotatable manner into a certain position within the certain angle range and can be locked in this position.

For this purpose, the retaining ring may have a slot which extends concentrically in relation to the axis of rotation of the balance staff and through which a locking screw can be screwed into a threaded bore formed in a balance cock in the region of the slot. The retaining ring can be braced against the balance cock.

If the slot here is arranged in the vicinity of, or in the region of, the inner clamping jaw, the region of the inner clamping jaw is retained in position in a particularly stable manner. The slot may be open at one end.

To reduce the number of components and to simplify assembly, the inner clamping jaw, the outer clamping jaw and the spring arm may be formed in one piece.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawing, wherein like reference characters denote similar elements throughout the several views.

DETAILED DESCRIPTION OF THE PRESENTLY PREFERRED EMBODIMENTS

Figure 1B:
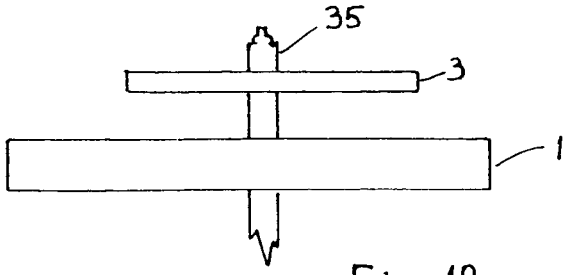
FIG. 1B is a side view of a balance wheel and helical spring of the oscillating system of FIG. 1A.
Figure 1A:
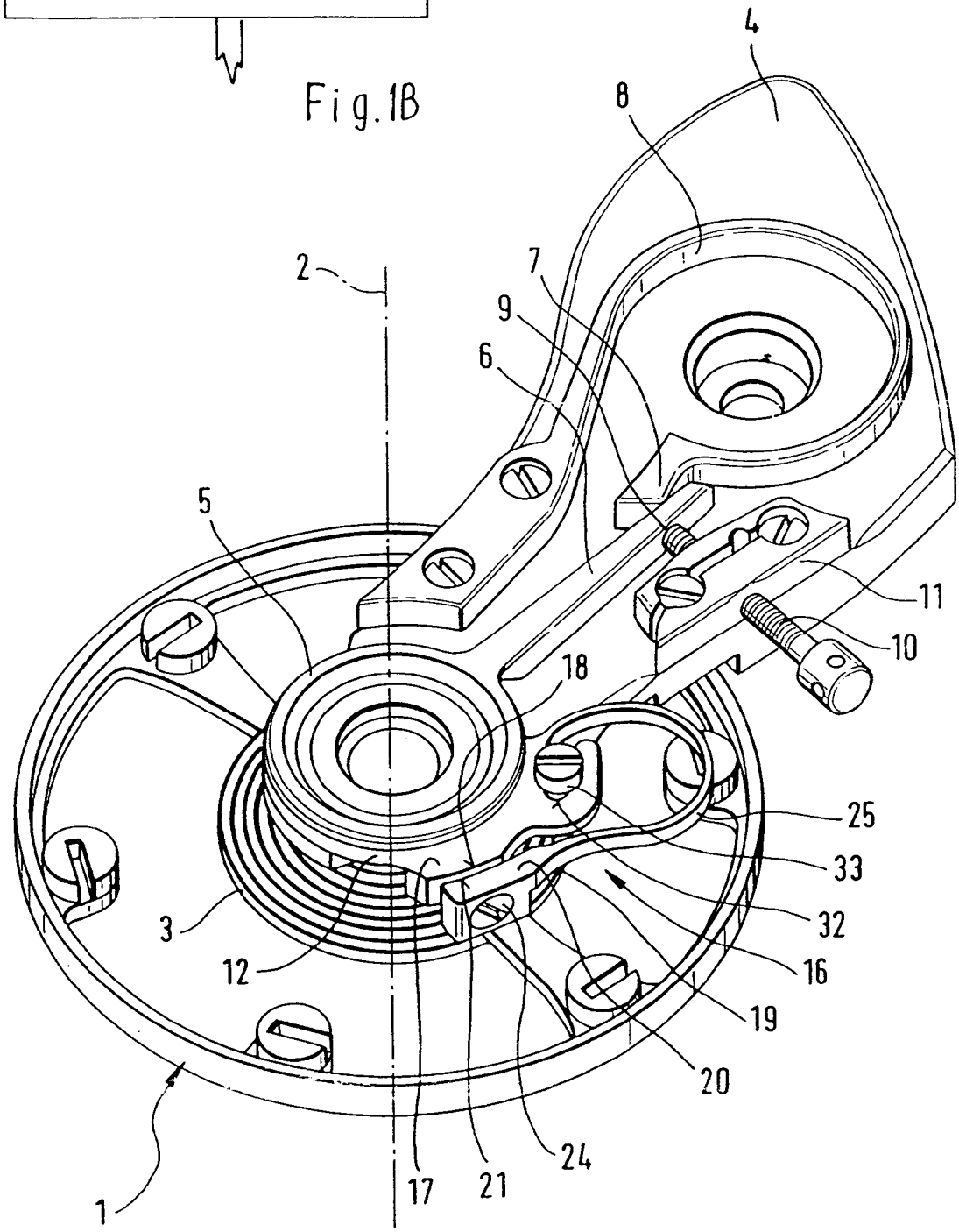
FIG. 1A is a perspective view of an oscillating system for a timepiece according to the present invention.

An oscillating system for a mechanical timepiece according to an embodiment of the present invention is illustrated in FIGS. 1A and 1B. The oscillating system includes an annular balance wheel 1 arranged in a fixed manner coaxially on a balance staff 35 (see FIG. 1B) and oscillates about the axis of rotation 2 of the balance staff.

The balance staff 35 is enclosed by a helical spring 3 approximately concentrically in relation to the axis of rotation 2. The inner end of the helical spring 3 is fastened on the balance staff.

The top end of the balance staff 35 is mounted, in a manner which is not illustrated, such that it can be pivoted in a fixed balance cock 4.

A cylinder component 5 is mounted in a rotatable manner on the balance cock 4 and arranged concentrically in relation to the axis of rotation 2. The cylinder component 5 has a radially projecting regulator pointer 6.

A free end 7 of a prestressed swan neck-shaped spring 8 acts In the vicinity of a free end of the regulator pointer 6 in a direction transverse to the axis of rotation 2. The other end of the swan neck-shaped spring 8 is fastened on the balance cock 4. The regulator pointer is retained in abutment against an end surface 9 of a precision setting screw 10. The precision setting screw 10 is arranged in a rotatable manner in a threaded bore of a block 11, which is fastened on the balance cock 4, and extends approximately in the direction of rotation of the regulator pointer 6. The regulator pointer 6 and the cylinder component 5 are pivoted by virtue of the precision setting screw 10 being screwed into or out of the threaded bore of the block 11.

The cylindrical lateral surface of the cylinder component 5 has an open retaining ring 12 engaging around it, this retaining ring butting with a friction fit, by way of a radially inwardly directed spring force, against the cylinder component 5. The inner radius of curvature of the retaining ring 12 is smaller in the region 14 alongside the opening 13 of the retaining ring 12 than in the region 15, which is located diametrically opposite the opening 13.

As a result of the friction fit by way of which the retaining ring 12 is arranged on the cylinder component 5, the retaining ring 12 is also pivoted when the regulator pointer 6 is pivoted.

When the regulator pointer 6 is secured, however, the retaining ring 12 can be rotated in relative terms on the cylinder component 5 if the friction fit is overcome.

Figure 2:
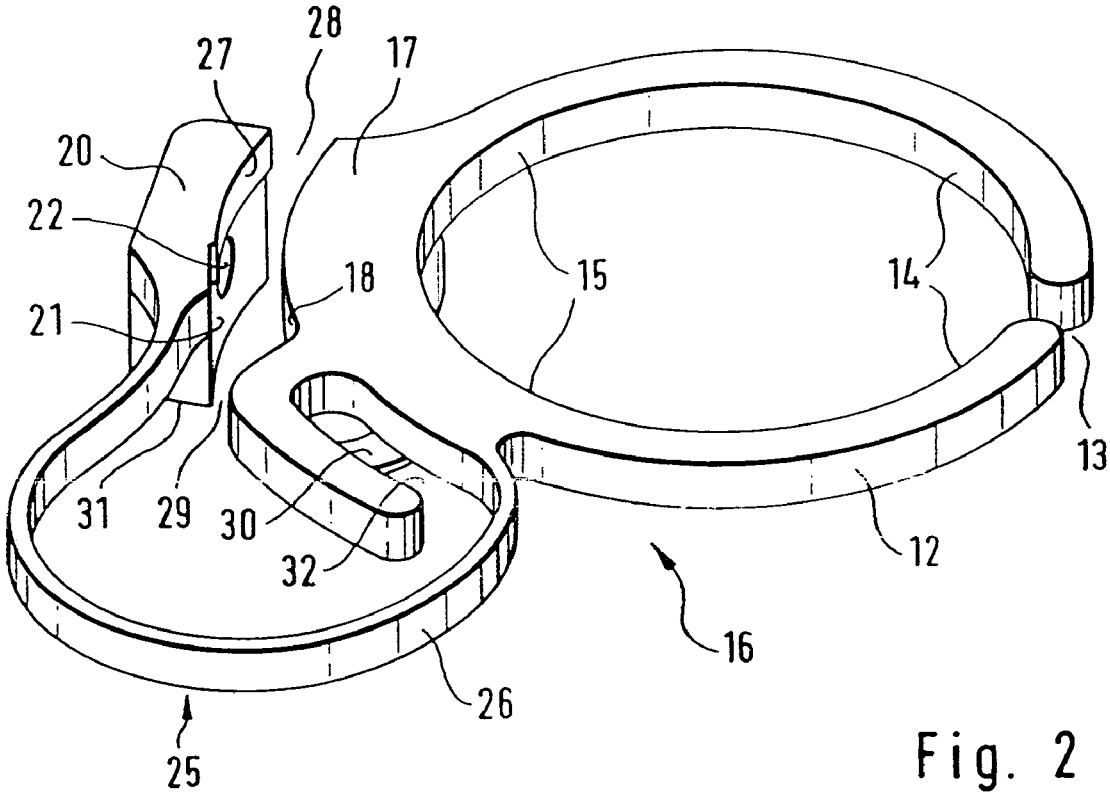
FIG. 2 is a perspective view of a helical-spring connector of the oscillating system according to FIG. 1A.
Figure 3:
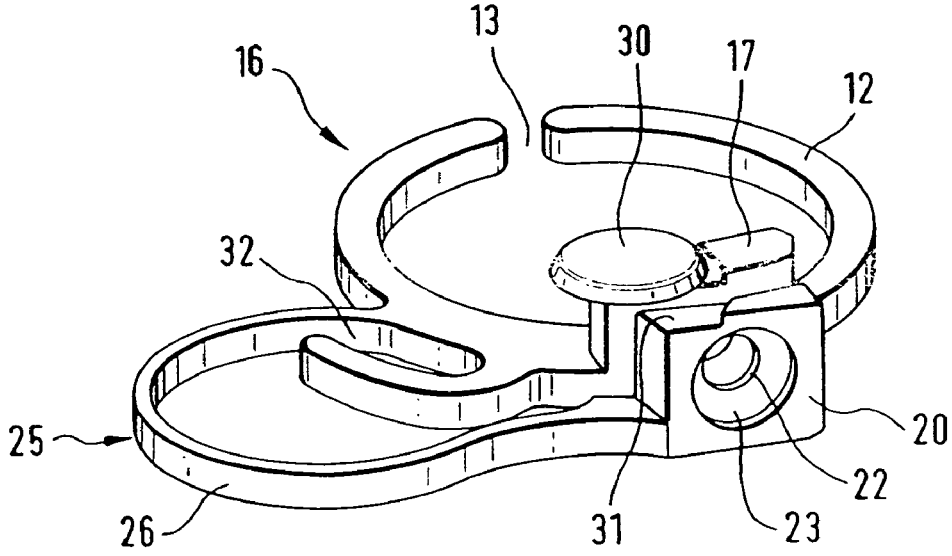
FIG. 3 is a perspective view of the helical-spring connector according to FIG. 2.

The retaining ring 12 is part of a helical-spring connector 16, which is illustrated in more detail in FIGS. 2 and 3.

An inner clamping jaw 17, which has a radially outwardly directed inner clamping surface 18 is arranged on the outer circumference of the retaining ring 12, the outer circumference being located approximately diametrically opposite the opening 13 of the retaining ring 12. This inner clamping surface 18 extends along a radius of curvature, in relation to the axis of rotation 2 of the balance staff, which corresponds to the radius of the outer end 19 of the helical spring 3.

An outer clamping jaw 20 is arranged opposite the inner clamping jaw 17 in the radially outward direction. The outer clamping jaw 20 has an outer clamping surface 21, which is confrontingly opposed to the inner clamping surface 18. This outer clamping surface 21 extends along a radius of curvature, in relation to the axis of rotation 2 of the balance staff 35, which is greater, by the thickness of the helical spring 3, than the radius of curvature of the inner clamping surface 18.

The outer clamping jaw 20 contains a through-aperture 22 extending radially in relation to the axis of rotation 2, which opens out approximately centrally into the outer clamping surface 21. A radially outer mouth-opening region of the through-aperture 22 is widened as a depression 23 for accommodating a countersunk head of a countersunk head screw 24, which forms a clamping screw.

The countersunk head screw 24 may be introduced into the aperture 22 radially from the outside and can have its threaded shank screwed into a threaded bore formed in the inner clamping jaw 17, the threaded bore is arranged approximately coaxially in relation to the aperture 22 and opens out centrally into the inner clamping surface 18.

The two clamping jaws 17 and 20 are connected to one another by a spring arm 25, which extends in the manner of a swan neck, approximately in a plane of the retaining ring 12, from the inner clamping jaw 17 to the outer clamping jaw 21. When the countersunk head screw 24 is loosened, the outer clamping jaw 20 is approximately radially movable in relation to the inner clamping jaw 17.

The spring arm 25 is a leaf-spring arm of approximately rectangular cross section, wherein the long cross-section sides 26 are directed parallel to the axis of rotation 2.

The outer end of the helical spring 3 is introduced into the space between the inner clamping surface 18 and the outer clamping surface 21 into an introduction region 28 on the side of the space which is located opposite the spring arm 25 and projects from an exit region 29 into the area enclosed by the spring arm 25. In this case, the helical spring 3 is guided along a plane beneath the countersunk head screw 24. A supporting surface 27 is formed In the region of the plane axially above the countersunk head screw 24, instead of the outer clamping surface 21. The supporting surface 27 is curved in relation to the axis of rotation 2 with a radius of curvature which corresponds to the radius of curvature of the inner clamping surface 18. The inner clamping surface 18 extends axially both over the region of the plane above the threaded bore and over the region of the plane beneath the threaded bore.

After the helical spring 3 has been introduced between the inner and outer clamping surfaces 18 and 21, the countersunk head screw 24 may be threaded into the threaded bore in the inner clamping jaw to move the outer clamping jaw 20 towards the inner clamping jaw 17 and fasten the helical spring 3 between the clamping surfaces 18 and 21 of these clamping jaws 17 and 20 by virtue of being clamped in.

The supporting surface 27 has its surface area butting against the inner clamping surface 18 directly in the top plane.

A stop 30 is arranged on the retaining ring 12 in the exit region 29 of the clamping jaws 17 and 20. The stop 30 projects in the direction of the outer clamping jaw 20. The outer end 19 of the helical spring 3 rests on the stop 30 and is supported axially in relation to the axis of rotation 2.

The stop 30 projects in the direction of the outer clamping jaw 20 to such an extent that, when the clamping jaws 17 and 20 are clamped together, the stop 30 abuts an underside 31 of the outer clamping jaw 20 and also supports the latter axially in relation to the axis of rotation 2. As a result, the torque which acts on the outer clamping jaw 20 when the countersunk head screw 24 is threaded in and out is prevented from twisting the clamping jaw 20 or the spring arm 25.

Starting from the inner clamping jaw 17, a slot 32 is formed in a widened portion of the retaining ring 12 which projects radially into the region enclosed by the spring arm 25, this slot being concentric in relation to the axis of rotation 2 and being open at its end which is opposite to the clamping jaw 17.

In the region covered by the slot 32, the balance cock 4 contains a threaded bore which is axial in relation to the axis of rotation 2 and into which it is possible to thread a locking screw 33 which projects through the slot 32. A screw head of the locking screw acts on the retaining ring 12 to brace the retaining ring 12 against the balance cock 4.

As shown in FIGS. 2 and 3 in particular, the helical-spring connector 16 is designed as a single-piece component which comprises the retaining ring 12, the inner clamping jaw 17, the spring arm 25, the outer clamping jaw 20 and the widened portion containing the slot 32, the stop 30 being arranged on the widened portion.

In order to adjust the oscillating system, the effective length of the helix is changed by loosening the countersunk head screw 24, thereby loosening the clamping of the outer end 19 of the helical spring 3 between the clamping jaws 17 and 20. Thereafter, the outer end 19 is gripped, e.g. by pincers, and drawn through between the clamping jaws 17 and 20 by a corresponding distance for effecting the required adjustment. The outer end 19 is then clamped again by tightening the countersunk head screw 24.

To correct the adjustment and render the balance wheel symmetrical in relation to the pallet, the locking screw 33 is loosened and the retaining ring 12, and with it the entire helical-spring connector 16, is rotated, with the friction fit on the cylinder component 5 being overcome, for rough adjustment. After rough adjustment, a precision adjustment may be performed by the precision setting screw 10 as a result of the joint rotation of the cylinder component 5 and helical-spring connector 16, with the friction fit between the cylinder component 5 and balance cock 4 being overcome. The helical-spring connector 16 is then fixed again by virtue of the locking screw 33 being tightened.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An oscillating system for a mechanical timepiece, comprising:

an annular balance wheel fixedly arranged on a rotatably mountable balance staff having an axis of rotation;

a helical spring enclosing said balance staff and having an inner end fastened on said balance staff and an outer end;

a fastening device, said annular balance wheel being rotatable relative to said fastening device, said fastening device having a helical-spring connector including an inner clamping jaw and an outer clamping jaw, said inner clamping jaw being arranged radially inside of said outer clamping jaw in relation to said axis of rotation;

a clamping screw operatively arranged for bracing said inner clamping jaw against said outer clamping jaw; and a spring arm connecting said outer clamping jaw to said inner clamping jaw, wherein said outer end of said helical spring is arranged between respective clamping surfaces of said inner clamping jaw and said outer clamping jaw for fixedly clamping said outer end between said clamping surfaces, and wherein said outer clamping jaw defines an aperture through which said clamping screw is guided, said aperture being directed approximately radially in relation to said balance staff, and said inner clamping jaw defining a threaded bore arranged approximately coaxial with said aperture, said clamping screw having a screw head supportable on said outer clamping jaw and a threaded shank threadably receivable in said threaded bore in said inner clamping jaw for bracing said inner clamping jaw against said outer clamping jaw.

2. The oscillating system of claim 1, wherein said inner clamping jaw is fixedly arranged relative to said fastening device and said outer clamping jaw approximately radially movable.

3. The oscillating system of claim 2, wherein said fastening device comprises a retaining ring, said inner clamping jaw being fastened on said retaining ring, said oscillating system further comprising a cylinder component arranged coaxially relative to said axis of rotation, said retaining ring engaging said cylinder component with one of a force fit, a form fit and a friction fit and being rotatably adjustable relative to said cylinder component through an angle range.

4. The oscillating system of claim 3, wherein said retaining ring is an open retaining ring having an opening located approximately diametrically opposite said inner clamping jaw and said retaining ring engages with a radially inwardly directed spring force around said cylinder component.

5. The oscillating system of claim 4, wherein an inner radius of curvature of said retaining ring is slightly larger in a region proximate said inner clamping jaw than in a region proximate said opening.

6. The oscillating system of claim 4, wherein said retaining ring is rotatably adjustable to a certain position within said angle range and lockable in the certain position.

7. The oscillating system of claim 6, wherein said retaining ring defines a slot extending concentrically in relation to said axis of rotation, said oscillating system further comprising a locking screw that is threadably insertable into a threaded bore in a balance cock such that said retaining ring braceable against the balance cock.

8. The oscillating system of claim 7, wherein said slot is arranged proximate said inner clamping jaw.

9. The oscillating system of claim 7, wherein said slot is open at one end.

10. The oscillating system of claim 3, wherein said cylinder component is rotatably adjustable about said axis of rotation and has a radially projecting regulator pointer.

11. The oscillating system of claim 10, further comprising a setting mechanism acting on said regulator pointer, wherein said regulator pointer is adjustable in a pivotable manner about said axis of rotation by said setting mechanism.

12. The oscillating system of claim 11, wherein said setting mechanism comprises a setting spring acting on said regulator pointer and a setting screw which pivots the regulator pointer counter to the force of said setting spring.

13. The oscillating system of claim 12, wherein said setting screw is a precision setting screw.

14. The oscillating system of claim 12, wherein said setting spring is a swan neck spring having a first end fixed relative to said axis of rotation and a second end which butts with a prestressing force against said regulator pointer.

15. The oscillating system of claim 1, wherein said clamping screw is a countersunk head screw and said screw head comprises a countersunk head, said aperture having a depression in a mouth-opening region of said aperture which is directed away from said inner clamping jaw for receiving said countersunk head.

16. The oscillating system of claim 1, wherein at least one of said clamping surfaces of said inner clamping jaw and said outer clamping jaw are curved approximately concentrically relative to said balance staff.

17. The oscillating system of claim 16, wherein said clamping surface of said outer clamping jaw is curved concentrically in relation to said axis of rotation with a radius of curvature which is greater, by approximately a thickness of said helical spring, than a radius of curvature of the clamping surface of said inner clamping jaw, wherein said clamping surface of said inner clamping jaw is also curved concentrically in relation to said axis of rotation.

18. The oscillating system of claim 1, wherein said clamping surface of said inner clamping jaw comprises a radius of curvature corresponding approximately to an internal radius of curvature of said outer end of said helical spring.

19. The oscillating system of claim 1, wherein said outer end of said helical spring extends axially relative to said axis of rotation adjacent a first axial side of said clamping screw and between said clamping surfaces of said inner and outer clamping jaws.

20. The oscillating system of claim 19, wherein said outer clamping jaw has a supporting surface arranged on a second axial side of said clamping screw opposite from said first axial side, said supporting surface being curved in relation to said axis of rotation with a radius of curvature which corresponds approximately to the radius of curvature of said clamping surface of said inner clamping jaw.

21. The oscillating system of claim 1, wherein said spring arm is a leaf-spring arm of approximately rectangular cross section having long cross-section sides directed parallel to the axis of rotation.

22. The oscillating system of claim 1, wherein said spring arm is a swan neck spring.

23. The oscillating system of claim 1, further comprising a stop arranged on said inner clamping jaw proximate said outer end of said helical spring, said stop projecting in the direction of said outer clamping jaw for axially supporting said outer end of said helical spring in relation to said axis of rotation.

24. The oscillating system of claim 23, wherein said outer clamping jaw is axially supported on said stop in relation to said axis of rotation.

25. The oscillating system of claim 1, wherein said inner clamping jaw, said outer clamping jaw and said spring arm are formed in only one piece.

26. The oscillating system of claim 1, wherein said inner clamping jaw and said retaining ring are formed in only one piece.

* * * * *